US005862642A

United States Patent [19]

Erwin

[11] Patent Number: 5,862,642

[45] **Date of Patent: *Jan. 26, 1999**

[54] REINFORCED COMPOSITE DECK POST

[75] Inventor: Ronald Dean Erwin, Fayetteville, Ga.

[73] Assignee: Erwin Industries, Inc., Peachtree City, Ga.

[ * ] Notice: The term of this patent shall not extend beyond the expiration date of Pat. No. 5,617,697.

[21] Appl. No.: 959,567

[22] Filed: Oct. 28, 1997

[51] Int. Cl.[6] ..... E04C 3/30

[52] U.S. Cl. ..... 52/736.3; 52/737.4; 52/720.2; 52/263; 256/65; 256/19

[58] Field of Search ..... 52/736.3, 737.3, 52/737.4, 736.1, 736.2, 736.4, 263, 238.1, 720.2; 256/19, 20, 21, 22, 70, 65, 59, DIG. 5

[56] References Cited

U.S. PATENT DOCUMENTS

| | | | |
|---|---|---|---|
| 849,951 | 4/1907 | White | 52/737.4 |
| 1,350,689 | 8/1920 | Trudelle | 52/736.3 X |
| 1,903,907 | 4/1933 | Riemenschneider . | |
| 3,131,792 | 5/1964 | Groneman . | |
| 3,200,554 | 8/1965 | Goodman . | |
| 3,875,712 | 4/1975 | Thompson | 52/263 |
| 3,917,368 | 11/1975 | Gusdorf . | |
| 3,998,028 | 12/1976 | Pelletier et al. | 52/737.4 |
| 4,038,802 | 8/1977 | Bajorek . | |
| 4,269,545 | 5/1981 | Finney . | |
| 4,461,461 | 7/1984 | Caron . | |
| 4,691,484 | 9/1987 | Wilson . | |
| 4,702,459 | 10/1987 | Moschner . | |
| 4,768,323 | 9/1988 | Coutant et al. | 52/731.6 |
| 4,918,880 | 4/1990 | Carney . | |
| 4,955,173 | 9/1990 | Czechowski . | |
| 5,255,899 | 10/1993 | Von Grozny | 256/19 X |
| 5,471,809 | 12/1995 | Frankel . | |
| 5,507,473 | 4/1996 | Hammer et al. | 256/19 X |
| 5,528,870 | 6/1996 | Zamerovsky . | |
| 5,572,846 | 11/1996 | DeSouza | 256/19 X |
| 5,617,697 | 4/1997 | Erwin . | |

FOREIGN PATENT DOCUMENTS

| | | |
|---|---|---|
| 1.540.643 | 10/1967 | France . |
| 2 540 923 | 11/1983 | France . |

*Primary Examiner*—Carl D. Friedman
*Assistant Examiner*—Winnie S. Yip
*Attorney, Agent, or Firm*—Arthur A. Gardner & Associates, P.C.

[57] ABSTRACT

A reinforced composite deck post comprises an elongate, hollow, extruded plastic shell, with the plastic shell being rectangular in cross-section. The plastic shell has an upper end and a lower end and has a notch formed therein adjacent the lower end for receiving a wood joist of a wood deck. The reinforced composite deck post also includes an elongate metal stiffening member positioned within the plastic shell and rigidly secured thereto generally adjacent the upper end of the plastic shell. Upper and lower shim means are positioned within the plastic shell adjacent the metal stiffening member for securing the metal stiffening member to the plastic shell.

16 Claims, 2 Drawing Sheets

REINFORCED COMPOSITE DECK POST

TECHNICAL FIELD

The present invention is directed to decking, and in particular to posts for decking.

BACKGROUND OF THE INVENTION

Outdoor decks are extremely popular in residential home construction. Homes and apartments, as well as a variety of other buildings, often incorporate exterior decks into their design. Additionally, decks are commonly added onto existing structures and landscapes. These decks provide convenient spaces for a variety of outdoor activities, including cookouts, dining and sunbathing, as well as other leisure activities. Moreover, decks typically are provided with a railing or perimeter fence to keep people from falling over the edge of the deck.

Wood products traditionally have been the primary source of materials for use in decking construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long-lasting substitute construction materials that can lessen the need to harvest timber resources.

One potential approach to addressing the above need is to provide substitute decking products made of plastic, rather than wood. However, because the deck products must be capable of sustaining certain loads, the replacement products need to be stable and rigid. The material should also be capable of economical manufacture, and be relatively inexpensive. It also needs to be easily installed and used in the field.

A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits.

U.S. Pat. No. 3,764,245 describes an apparatus for producing a light structural board of thermoplastic resin.

U.S. Pat. No. 5,253,458 describes a simulated log made from a cast polyvinylchloride (PVC) pipe, selectively filled with a hard cast foam or bead type foam. This patent further describes that the cast PVC pipe is first manufactured and then subsequently filled with the foam filler.

U.S. Pat. No. 5,617,697 of Erwin (also the current Applicant) describes a composite deck post for use with a wood joist of wood deck which includes an elongate, hollow, extruded plastic shell in which an elongate tubular metal stiffening member is positioned therewithin and is rigidly secured thereto using a metal fastener that extends through the plastic shell and the stiffening member. While this arrangement serves as an excellent replacement for traditional lumber products, in many situations it may be desirable to eliminate the use of the metal fastener extending through the plastic shell to secure the metal stiffening member therewithin.

Accordingly, it can be seen there is a need yet in the art for replacement decking components as a replacement for traditional wood products, which provide a strong finished product at minimal cost, which are weather resistant and which can be produced and installed easily. It is to the provision of such decking components that the present invention is primarily directed.

SUMMARY OF THE INVENTION

Briefly described, in a first preferred form the present invention comprises a reinforced composite deck post for use with a wood joist of a wood deck and for attachment thereto. The reinforced composite deck post comprises an elongate, hollow, extruded plastic shell, with the plastic shell being rectangular in cross-section. The plastic shell has an upper end and a lower end and has a notch formed therein adjacent the lower end for receiving a wood joist of the wood deck. The composite deck post also includes an elongate metal stiffening member positioned within the plastic shell and secured thereto generally adjacent the upper end of the plastic shell. Upper and lower shim means are positioned within the plastic shell adjacent the metal stiffening member for securing the metal stiffening member to the plastic shell.

Preferably, the upper and lower shim means are adapted to wedge the metal stiffening member within the plastic shell. Also preferably, the upper and lower shim means can be fabricated as wood blocks or from polyurethane foam.

Also preferably, the metal stiffening member is generally hollow and includes an insert in a lower portion thereof. Preferably, the insert is adjacent the notch and is made from wood or plastic foam.

In another preferred form, the present invention comprises a reinforced composite deck post for use with a wood joist of a wood deck and for attachment thereto. The reinforced composite deck post comprises an elongate, hollow, extruded plastic shell which is rectangular in cross-section and has an upper end and a lower end. The plastic shell further has a notch formed therein adjacent the lower end for receiving a wood joist. An elongate metal stiffening member is positioned within the plastic shell and is secured thereto generally adjacent the upper end of the plastic shell. An upper shim means is positioned within the plastic shell adjacent the metal stiffening member for securing the metal stiffening member to the plastic shell. Further, the metal stiffening member is generally hollow and includes a rigid insert positioned therewithin generally adjacent the notch formed in the plastic shell.

With this construction, the reinforced composite deck post is easily and quickly attached to a wood joist. Furthermore, the resulting structure is easily manufactured and installed, is very strong and sturdy, and is quite weatherable. The reinforced composite deck post is very easy to manufacture, provides excellent appearance, and provides good strength (both in terms of bending resistance and compression load-carrying capability).

Accordingly, it is an object of the present invention to provide a reinforced composite deck post which is economical in manufacturing and application, durable in construction, and simple. It is another object of the present invention to provide a reinforced composite deck post which has good strength and rigidity for use in deck railing.

It is another object of the present invention to provide a reinforced composite deck post which, other than where it is attached to the wood joist, is free from fasteners and fastener holes extending therein.

These and other objects, advantages, and features of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
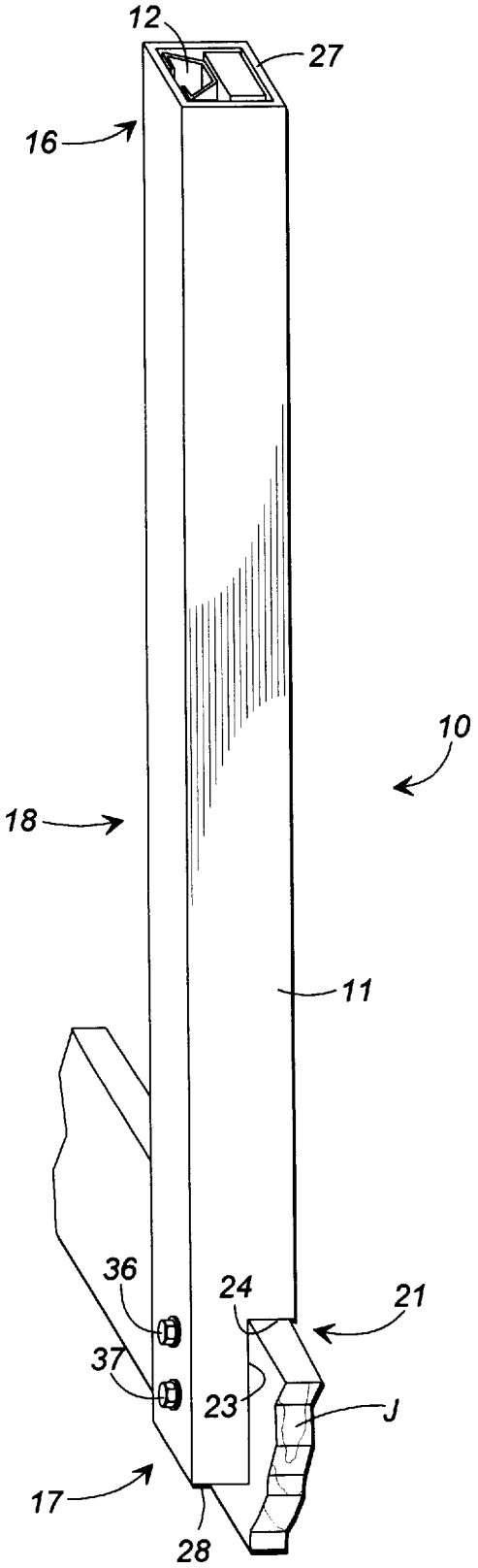
FIG. 1 is a perspective illustration of a reinforced composite deck post according to a preferred form of the invention.

Referring now to the drawing figures, wherein like reference numerals represent like parts throughout the several views, FIGS. 1–5 show a reinforced composite deck post 10 according to a preferred form of the invention. The reinforced composite deck post 10 generally comprises a rigid plastic outer shell 11 and a steel reinforcing element 12. Preferably, the outer shell is made of polyvinylchloride (PVC).

The PVC outer shell 11 includes, an upper end section 16, a lower second section 17, and an intermediate section 18 between the upper and lower sections. As depicted in the drawing figures preferably the plastic outer shell 11 has a square cross-section (best seen in FIG. 4 and FIG. 1). Other rectangular shapes could work as well. The square PVC outer shell 11 is made as an extrusion and is then cut to length.

Figure 2:
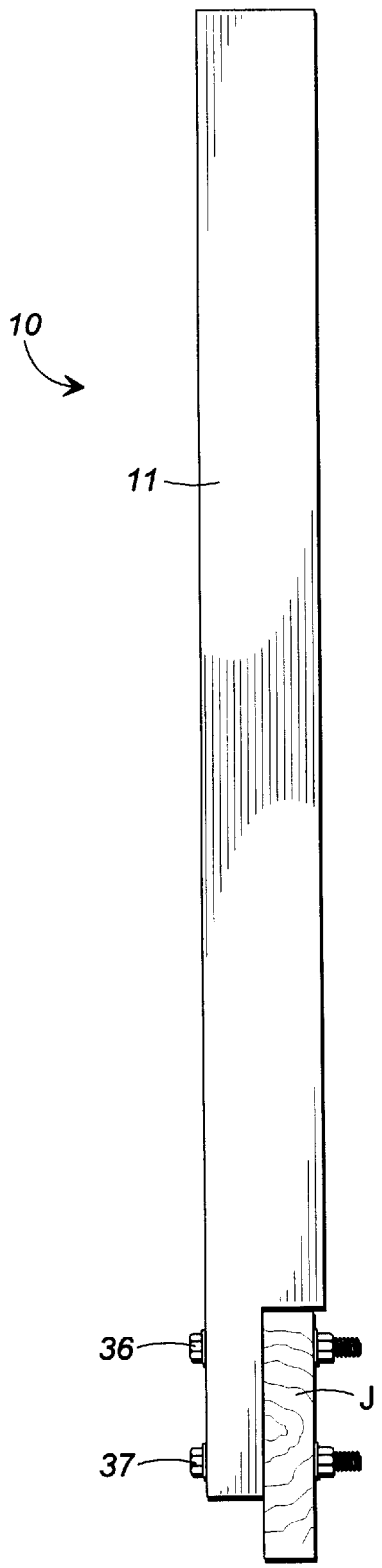
FIG. 2 is a side view of the reinforced composite deck post of FIG. 1.
Figure 3:
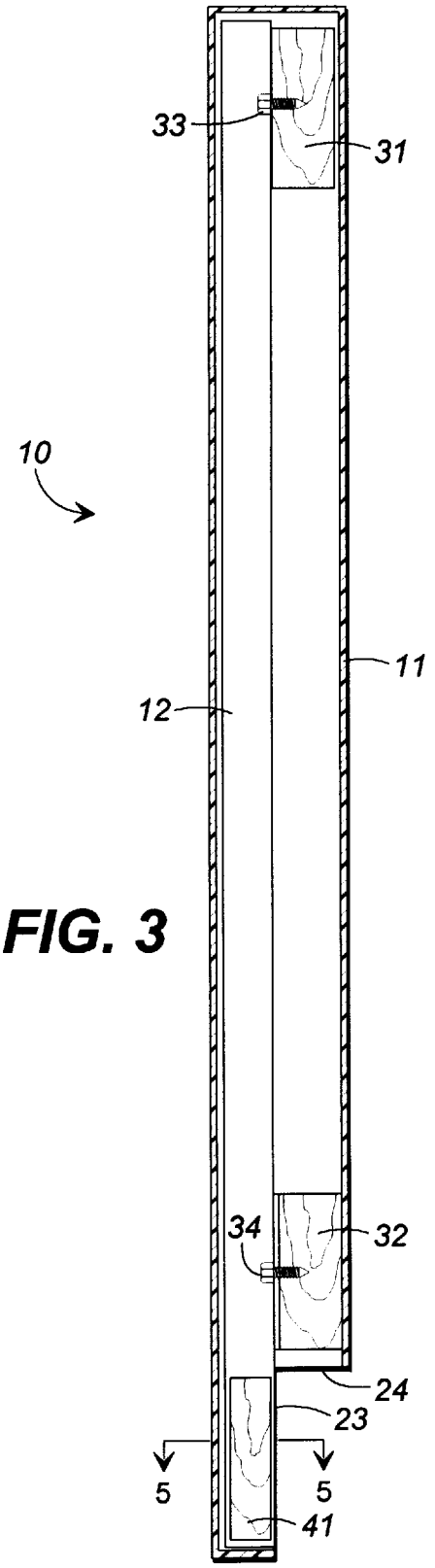
FIG. 3 is a partially cut-away, side view of the reinforced composite deck post of FIG. 1.

At the lower end 17 of the outer shell 11, a notch 21 is formed for mounting the reinforced composite deck post to a wood joist of a wood deck. In FIGS. 1 and 2, a wood joist J is shown. The notch 21 is rectangular for receiving the wood joist and is formed by making perpendicular saw cuts in the lower end 17 of the plastic outer shell 11. The notch 21 includes a cheek or face 23 and a shoulder 24. Preferably, the plastic shell 11 has a wall thickness of 0.150 inches and a maximum of dimension of 43 inches from an upper face or upper edge 27 to a lower face or lower edge 28. Preferably, the notch 21 has a height of approximately 5½ inches to accept standard "2×6" lumber.

Figure 4:
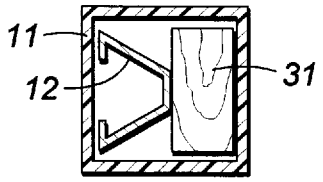
FIG. 4 is a top view of the reinforced composite deck post of FIG. 1.
Figure 5:
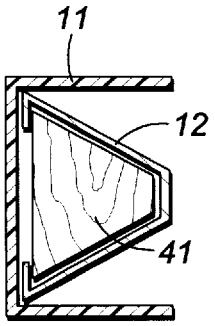
FIG. 5 is a sectional view of the reinforced composite deck post of FIG. 3, viewed along lines 5—5.

The metal reinforcing element 12 is made from G-90 galvanized steel with a wall thickness of 0.100 inches. The metal stiffening element 12 is generally trapezoidal in shape, as best seen in FIGS. 4 and 5. In this regard, it is noted that there is a generally open side of the metal reinforcing member 12. This construction allows the metal reinforcing element to be economically manufactured by bending or otherwise forming flat sheet stock into the desired shape. Preferably, the metal reinforcing member 12 is 39 inches long and is rigidly secured to an inside face of the plastic outer shell 11 by wedges or shims 31 and 32. The wedges or shims 31 and 32 preferably are made of blocks of wood. However, other materials can be employed. For example, the wedges or shims could be made of hard plastic blocks. Or, the wedges could be in the form of a hard plastic foam, such as polyurethane foam. What is important is that the wedges secure the metal reinforcing member 12 against longitudinal movement within the rigid plastic shell 11 prior to the reinforced composite deck post being permanently mounted to a deck joist. Note that after the reinforced composite deck post 10 is mounted to a joist, there should be little opportunity for the metal reinforcing members 12 to move about.

Preferably, the metal reinforcing member 12 does not extend all the way to the top edge 27 of the plastic shell 11, in order to allow lateral side rails to be mounted to and extended into an upper-most portion of the plastic shell 11. While for clarity the drawing figures depict the metal reinforcing element 12 as extending essentially to the very top of the plastic shell 11, those skilled in the art will hereby understand that the metal reinforcing member can be stopped well short of the top in order to provide the necessary clearance. Threaded fasteners, such as fasteners 33 and 34 are used to secure the metal reinforcing member 12 to the shims 31 and 32 during manufacturing to facilitate easy assembly. At the lower end 17 of the rigid plastic shell 11, the plastic shell and the steel stiffening member are bolted to a wood joist using a pair of fasteners 36 and 37.

In a lower portion of the metal stiffening member 12 adjacent the notch in the rigid plastic shell 11, a crush-resistant insert 41 is positioned. The crush resistant insert 41 has a trapezoidal cross-section and is adapted and sized to be fitted snugly within the interior of the generally trapezoidal metal stiffening member 12. If desired, the crush-resistant insert can be secured to the metal stiffening member by screws prior to insertion into the interior of the plastic shell 11. The crush-resistant insert 41 preferably is made of wood, although other materials such as plastic or rigid plastic foam can be employed. The crush-resistant insert 41 helps to prevent the metal stiffening member 12 from being crushed when the reinforced composite deck post 10 is bolted to the wood joist using the fasteners 36 and 37.

The cost of manufacturing such a reinforced composite deck post is quite reasonable. Also, by the combination of the rigid plastic outer shell, the steel stiffening member and the insert, a strong, stiff deck post is achieved. The reinforced composite deck post so constructed meets typical building code requirements for strength. The resulting reinforced composite deck post is quite weather-resistant and is even more weather-resistant than the invention of the Applicant's prior U.S. Pat. No. 5,617,697 by the elimination of a bolt and bolt hole extending through the outside of the composite deck post up near the top thereof. This more completely conceals the weatherable steel element within the interior of the weather-resistant plastic shell.

While the invention has been disclosed in a preferred form, it will be apparent to those skilled in the art that certain modifications, additions, and deletions can be made therein without departing from the spirit and scope of the invention as set forth in the following claims. For example, other plastic materials can be used for the shell besides PVC and the steel stiffening member can be replaced with an aluminum stiffening member. These and other modifications nonetheless fall within the scope of the invention as set forth in the following claims.

I claim:

1. A reinforced composite deck post for use with a wood joist of a wood deck and for attachment thereto, the composite deck post comprising:

an elongate, hollow, extruded plastic shell, said plastic shell being rectangular in cross-section and having an upper end and a lower end, said plastic shell having a notched formed therein adjacent said lower end for receiving a wood joist of a wood deck;

an elongate metal stiffening member positioned within said plastic shell and secured thereto; and upper and lower shim means positioned within said plastic shell adjacent said metal stiffening member for securing said metal stiffening member to said plastic shell.

2. A reinforced composite deck post as claimed in claim 1 wherein said upper and lower shim means wedging said metal stiffening member within said plastic shell.

3. A reinforced composite deck post as claimed in claim 1 wherein said upper and lower shim means comprises wooden blocks.

4. A reinforced composite deck post as claimed in claim 1 wherein said upper and lower shim means comprise polyurethane foam.

5. A reinforced composite deck post as claimed in claim 1 wherein said metal stiffening member is generally hollow.

6. A reinforced composite deck post as claimed in claim 5 further comprising an insert positioned within said metal stiffening member.

7. A reinforced composite deck post as claimed in claim 6 wherein said insert comprises a wooden block.

8. A reinforced composite deck post as claimed in claim 6 wherein said insert comprises rigid plastic foam.

9. A reinforced composite deck post as claimed in claim 6 wherein said insert is adjacent said notch.

10. A reinforced composite deck post as claimed in claim 5 wherein said metal stiffening member is generally trapezoidal.

11. A reinforced composite deck post for use with a wood joist of a wood deck and for attachment thereto, the composite deck post comprising:

an elongate, hollow, extruded plastic shell, said plastic shell being rectangular in cross-section and having an upper end and a lower end, said plastic shell having a notch formed therein adjacent said lower end for receiving a wood joist of a wood deck;

an elongate, generally tubular metal stiffening member positioned within said plastic shell and secured thereto generally adjacent said upper end of said plastic shell;

an upper shim means positioned within said plastic shell adjacent said metal stiffening member for securing said metal stiffening member to said plastic shell; and an insert positioned within said metal stiffening member generally adjacent said notch.

12. A reinforced composite deck post as claimed in claim 11 further comprising a lower shim means positioned within said plastic shell adjacent said metal stiffening member for securing said metal stiffening member to said plastic shell.

13. A reinforced composite deck post as claimed in claim 12 wherein said upper and lower shim means comprise wooden blocks.

14. A reinforced composite deck post as claimed in claim 12 wherein said upper and lower shim means comprise polyurethane foam.

15. A reinforced composite deck post as claimed in claim 11 wherein said insert comprises a wooden block.

16. A reinforced composite deck post as claimed in claim 11 wherein said insert comprises plastic foam.

* * * * *